US009450293B2

(12) United States Patent
Su et al.

(10) Patent No.: US 9,450,293 B2
(45) Date of Patent: Sep. 20, 2016

(54) WIRELESS COMMUNICATION DEVICE

(71) Applicant: Chiun Mai Communication Systems, Inc., New Taipei (TW)

(72) Inventors: Wei-Cheng Su, New Taipei (TW); Yen-Hui Lin, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 324 days.

(21) Appl. No.: 14/011,921

(22) Filed: Aug. 28, 2013

(65) Prior Publication Data

US 2014/0062803 A1 Mar. 6, 2014

(30) Foreign Application Priority Data

Aug. 31, 2012 (TW) ..... 101131943 A

(51) Int. Cl.

*H01Q 1/24* (2006.01)
*H01Q 1/42* (2006.01)
*H01Q 9/42* (2006.01)

(52) U.S. Cl.

CPC ..... *H01Q 1/243* (2013.01); *H01Q 1/42* (2013.01); *H01Q 9/42* (2013.01)

(58) Field of Classification Search

CPC ..... H01Q 1/38; H01Q 1/243; H01Q 9/0421
USPC ..... 343/702, 767, 872, 878
See application file for complete search history.

(56) References Cited

U.S. PATENT DOCUMENTS

2004/0066339 A1* 4/2004 Lin ..... H01Q 9/0421 343/700 MS
2007/0285321 A1* 12/2007 Chung ..... H01Q 1/38 343/702
2011/0006953 A1* 1/2011 Chiang ..... G06F 1/1616 343/702
2012/0274538 A1* 11/2012 Tsou ..... H01Q 1/243 343/876

* cited by examiner

*Primary Examiner* — Dameon E Levi
*Assistant Examiner* — Collin Dawkins
(74) *Attorney, Agent, or Firm* — Zhigang Ma

(57) ABSTRACT

A wireless communication device includes a housing and an antenna. The housing is made of metal and defines a conductive chamber. The chamber includes a bottom wall, two opposite first side walls, and two opposite second side walls connecting to the first side walls, the first side walls and the second side walls surrounding around the bottom wall. The antenna comprises a radiating body, a feed end, and a ground end. The radiating body is suspended above the chamber and distanced from the conductive chamber in such a way that the antenna functions in a resonance mode with the conductive chamber, in operating at the required frequencies. The feed end and ground end extend from the radiating body and are connected to one of the second side walls.

18 Claims, 7 Drawing Sheets

WIRELESS COMMUNICATION DEVICE

BACKGROUND

1. Technical Field

The disclosure generally relates to wireless communication devices, and particularly to a wireless communication device having an integrated metal appearance and a better transmitting performance.

2. Description of Related Art

Metal shells are widely used in wireless communication devices because of the advantages of mechanical strength, resistance to deformation, and tactile sensation. However, the metal shells may shield and interfere with signals radiated by antennas of the wireless communications and narrows working frequencies of the antennas.

In a conventional way to reduce the interference, the wireless communication device commonly includes a housing having a non-metal portion (such as a plastic portion) adjacent to the antenna so that the antenna is apart from a metal portion of the housing. However, the joint between the non-metal portion and the metal portion does not have an integrated or seamless appearance.

Therefore, there is room for improvement within the art.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the disclosure.

DETAILED DESCRIPTION

Figure 1:
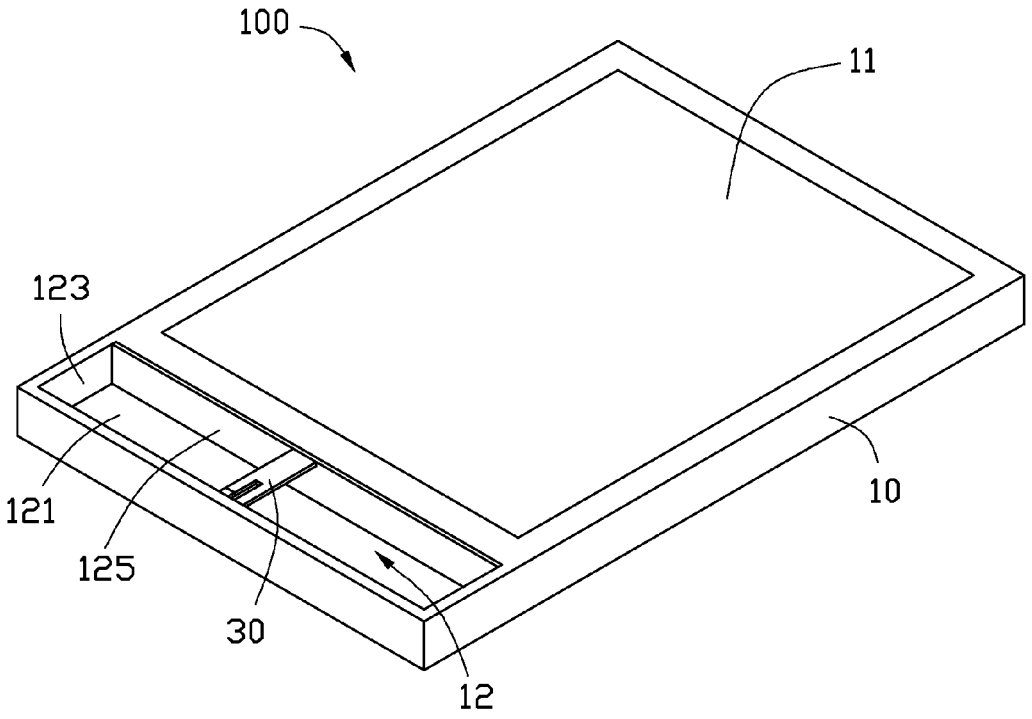
FIG. 1 is a schematic view of a wireless communication device having an antenna, according to a first exemplary embodiment of the disclosure.

FIG. 1 is a schematic view of a wireless communication device 100, according to a first exemplary embodiment of the disclosure. The wireless communication device 100 includes a housing 10 and an antenna 30 positioned in the housing 10.

The housing 10 is substantially rectangular and made of metal. A screen 11 is positioned on a first end of the housing 10. A chamber 12 is defined in a second end of the housing 10 adjacent to the screen 10. The chamber 12 includes a bottom wall 121, two opposite first side walls 123, and two opposite second side walls 125 connected to the first side walls 123. The first side walls 123 and the second side walls 125 surround the bottom wall 121. A length of each of the second side walls 125 is slightly longer than that of each of the first side walls 123. In this exemplary embodiment, the chamber 12 is substantially rectangular.

Figure 2:
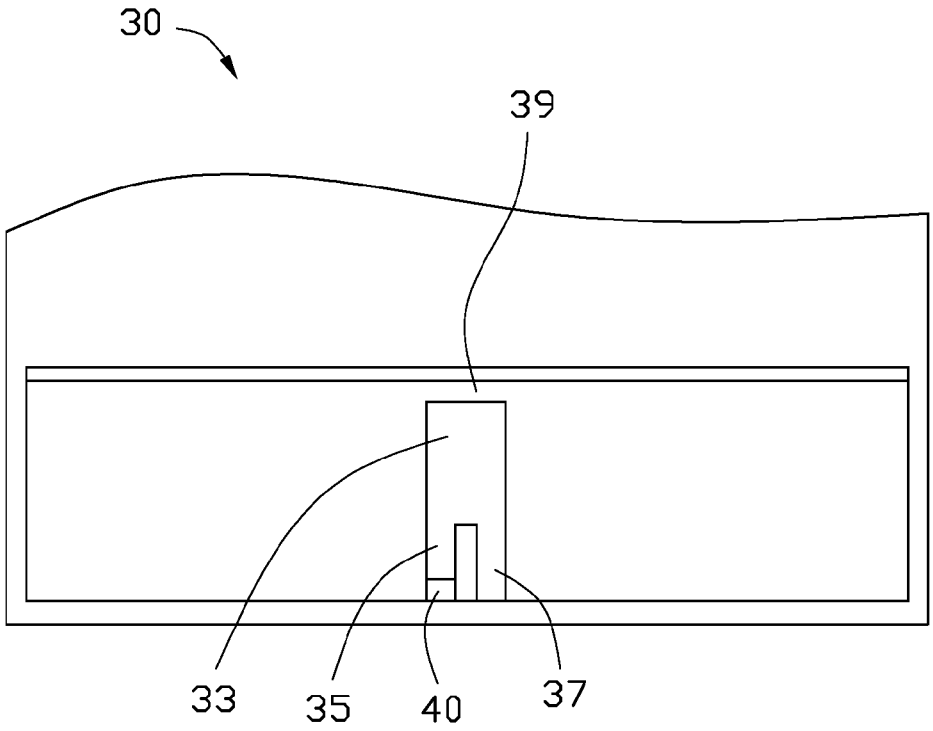
FIG. 2 is a top view, schematic view of the wireless communication device of FIG. 1.

Also referring to FIG. 2, the antenna 30 is a single-pole antenna including a radiating body 33, a feed end 35, and a ground end 37. The radiating body 33 is made of conductive materials such as a metal sheet or a flexible printed circuit board. In this exemplary embodiment, the radiating body 33 is substantially a rectangular sheet. The feed end 35 and the ground end 37 are both strip-shaped. A length of the feed end 35 is slightly shorter than that of the ground end 37. The feed end 35 and the ground end 37 extend from a first end of the radiating body 33, and are parallel and spaced from each other. The feed end 35 is connected to one of the second side walls 125 far away from the screen 11 by a connection member 40. The connection member 40 may be a coaxial cable. The ground end 37 is directly connected to the other of the second side walls 125. The radiating body 33 is suspended above a central portion of the chamber 12. A second end of the radiating body 33 opposite to the feed end 35 and the ground end 37 defines a first gap 39 with the other of the second side walls 125 adjacent to the screen 11. A width of the first gap 39 can be changed to facilitate the antenna 30 functioning in a resonance mode with the chamber 12 and obtain a first working frequency band. In the first exemplary embodiment, the first working frequency band is the GPS frequency band or the WiFi 2.4 GHz. The antenna 30 can be supported by a base formed by screen glass or an antenna carrier or the like.

In this exemplary embodiment, the dimensions of the chamber 12 are about 50 mm×10 mm×8 mm. The dimensions of the radiating body 33 are about 9.8 mm×3 mm. The width of the first gap 39 is about 0.2 mm.

In other exemplary embodiments, the chamber 12 can be entirely formed within the housing 10 and also can be cooperatively formed by the housing 10 and other metal member such as a metal rear cover of the screen 11, a system ground plane, a metal shield, or a metal plane.

Figure 3:
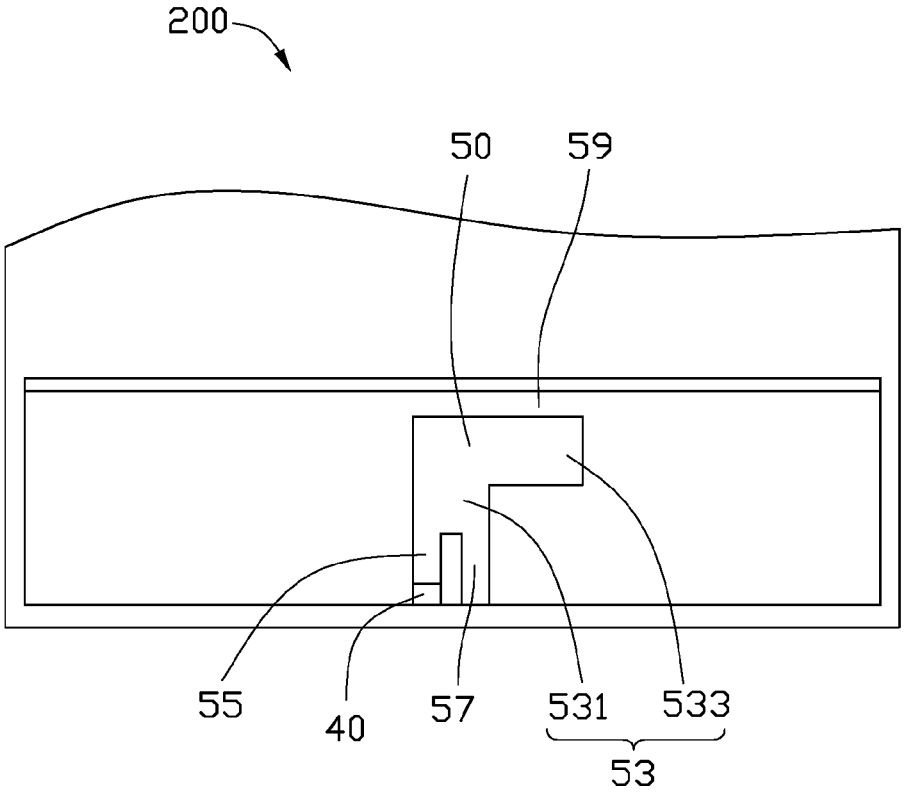
FIG. 3 is a top, schematic view of a wireless communication device having an antenna, according to a second exemplary embodiment of the disclosure.

FIG. 3 is a schematic view of a wireless communication device 200, according to a second exemplary embodiment of the disclosure. The wireless communication device 200 is substantially similar to the wireless communication device 100. The wireless communication device 200 includes a housing 10 and antenna 50. The antenna 50 includes a radiating body 53, a feed end 55 and a ground end 57.

The difference between the wireless communication device 200 and the wireless communication device 100 is that the radiating body 53 of the wireless communication device 200 is substantially L-shaped. The radiating body 53 includes a first radiating section 531 and a second radiating section 533 perpendicularly connected to the first radiating section 531. The feed end 55 and the ground end 57 extend from an end of the first radiating section 531 opposite to the second radiating section 533, and are parallel and spaced from each other. The second radiating section 533 defines a second gap 59 with one of the second side walls 125. The other structures of the wireless communication device 200 are substantially similar to the wireless communication device 100.

In the second exemplary embodiment, the dimensions of the chamber 12 are about 50 mm×10 mm×8 mm. The dimensions of the radiating body 53 are about 9 mm×7.6 mm. A width of the second gap 59 is about 1 mm.

Figure 4:
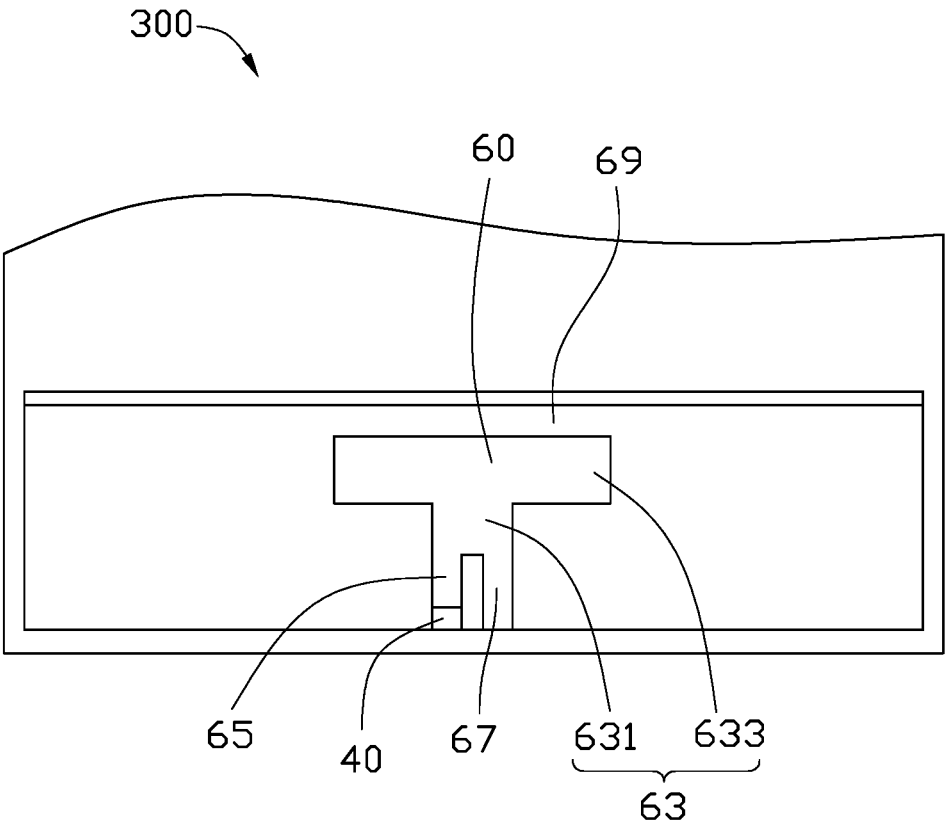
FIG. 4 is a top, schematic view of a wireless communication device having an antenna, according to a third exemplary embodiment of the disclosure.

FIG. 4 is a schematic view of a wireless communication device 300, according to a third exemplary embodiment of the disclosure. The wireless communication device 300 is substantially similar to the wireless communication device 100. The wireless communication device 300 includes a housing 10 and antenna 60. The antenna 60 includes a radiating body 63, a feed end 65 and a ground end 67.

The difference between the wireless communication device 300 and the wireless communication device 100 is that the radiating body 63 of the wireless communication device 300 is substantially T-shaped.

The radiating body 63 includes a first radiating section 631 and a second radiating section 633 perpendicularly connected to a middle portion of the first radiating section 631. The feed end 65 and the ground end 67 extend from an end of the first radiating section 631 opposite to the second radiating section 633, and are parallel and spaced from each other. The second radiating section 633 defines a third gap 69 with one of the second side walls 125. The other structures of the wireless communication device 300 are substantially similar to the wireless communication device 100.

In the third exemplary embodiment, the dimensions of the chamber 12 are about 50 mm×10 mm×8 mm. The dimensions of the radiating body 53 are about 12 mm×8.2 mm. A width of the third gap 69 is about 1.7 mm.

Figure 5:
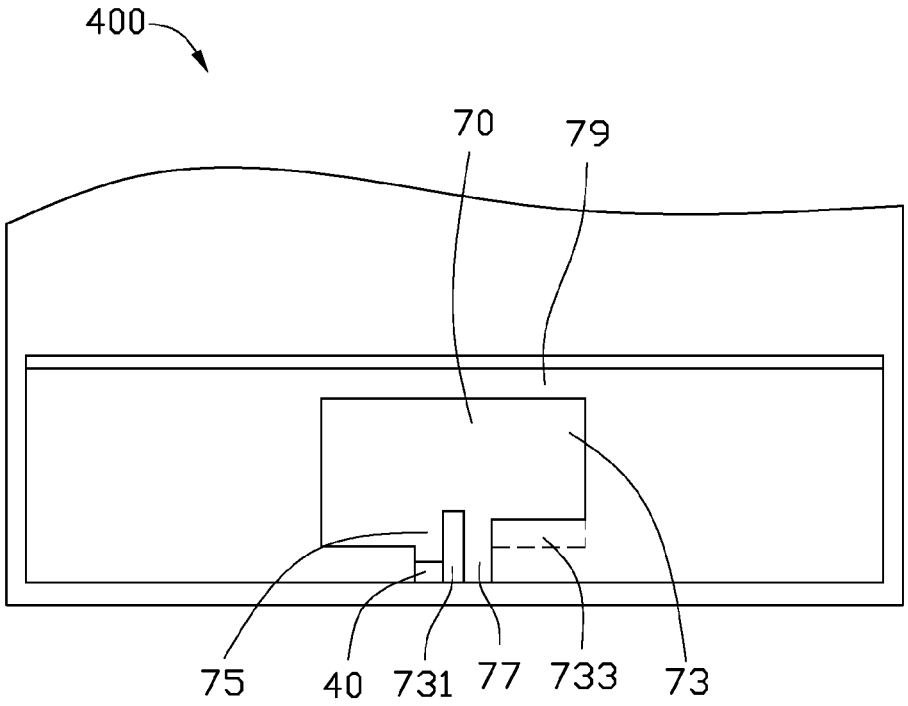
FIG. 5 is a top, schematic view of a wireless communication device having an antenna, according to a fourth exemplary embodiment of the disclosure.

FIG. 5 is a schematic view of a wireless communication device 400, according to a fourth exemplary embodiment of the disclosure. The wireless communication device 400 is substantially similar to the wireless communication device 100. The wireless communication device 400 includes a housing 10 and antenna 70. The antenna 70 includes a radiating body 73, a feed end 75 and a ground end 77.

The difference between the wireless communication device 400 and the wireless communication device 100 is that the radiating body 73 of the wireless communication device 400 is substantially rectangular. The feed end 75 and the ground end 77 are extended from one side of the radiating body 73, and are parallel and spaced from each other. A slot 731 is formed between the feed end 75 and the ground end 77. The radiating body 73 defines a cut 733 at one end of the radiating body 73 adjacent to the ground end 77. The radiating body 73 defines a fourth gap 79 with one of the second side walls 125. The other structures of the wireless communication device 400 are substantially similar to the wireless communication device 100.

In the fourth exemplary embodiment, the dimensions of the chamber 12 are about 50 mm×10 mm×8 mm. The dimensions of the radiating body 73 are about 16 mm×8.1 mm. A width of the fourth gap 79 is about 1.9 mm.

Figure 6:
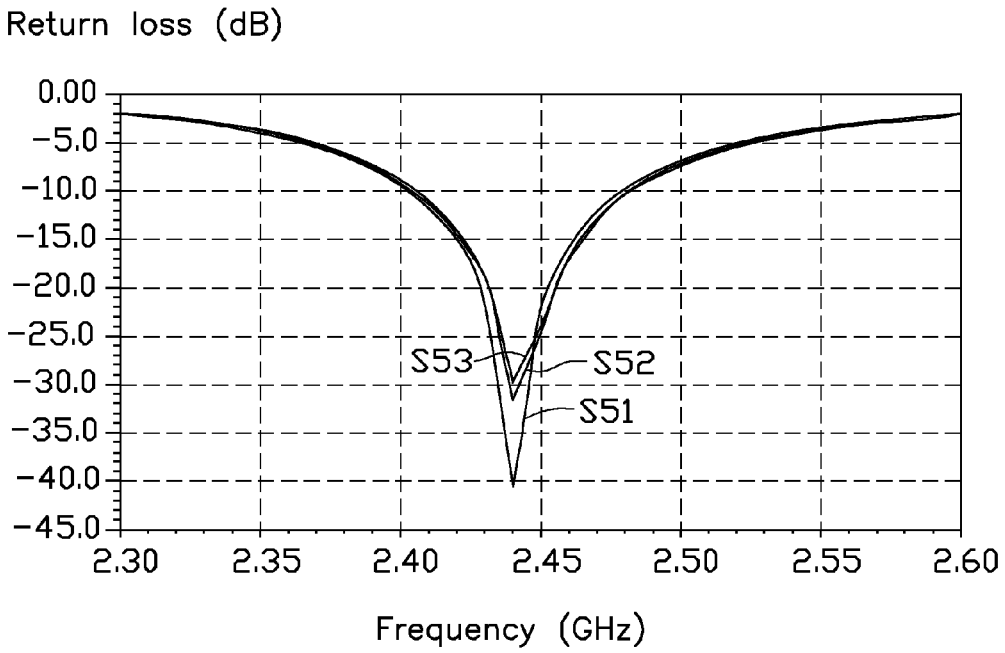
FIG. 6 is a diagram showing return loss (RL) measurements of the antennas shown in FIGS. 2-4.

The curves S51, S52, and S53 shown in FIG. 6 represent return loss of the antennas 30, 50 and 60 which are shown in FIGS. 2-4, respectively. According to test results shown in FIG. 6, each of the wireless communication devices 100, 200, 300 can work at a frequency band of Bluetooth/WiFi 2.4 GHz.

Figure 7:
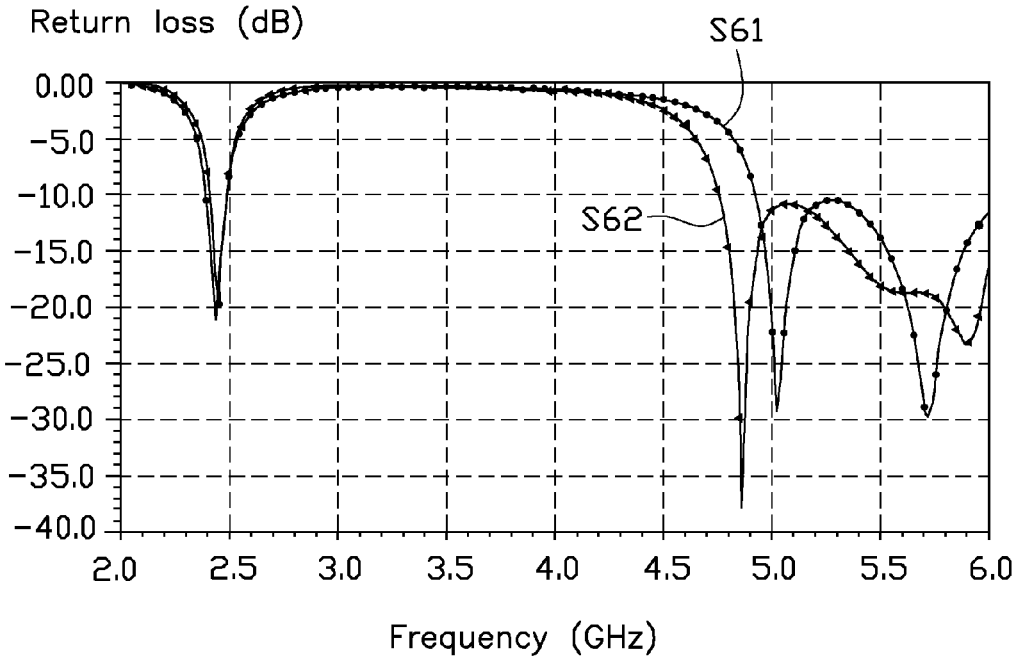
FIG. 7 is a diagram showing return loss (RL) measurements of the antenna shown in FIG. 5.

The curves S61 shown in FIG. 7 represent return loss of the wireless communication device 400 when the antenna 70 is positioned above a central portion of the chamber 12. The curves S62 represents return loss of the wireless communication device 400 when the antenna 70 is positioned away from the central portion of the chamber 12 and is positioned at a position having a distance about 0.5 mm from the first side wall 123. According to test results shown in FIG. 7, the wireless communication 400 also can work at the frequency band of Bluetooth/WiFi 2.4 GHz/5 GHz.

The antennas 30, 50, 60, 70 are coupled with the chamber 12 to function when able to resonate with the chamber 12 and obtain the necessary frequency bands. Thus, the housing 10 does not need to have a non-metal portion and can have an integrated metal appearance.

It is believed that the exemplary embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. A wireless communication device, comprising:

a housing, the housing defining a chamber, the chamber comprising a bottom wall, two opposite first side walls, and two opposite second side walls connected to the first side walls, the first side walls and the second side walls surrounding the bottom wall; and an antenna, the antenna comprising a radiating body, a feed end, and a ground end, the radiating body suspended above the chamber, the feed end and the ground end extending from the radiating body and connected to one of the second side walls, the feed end and the ground end being in parallel, a length of the feed end being slightly shorter than that of the ground end, the radiating body, the feed end and the ground end being coplanar;

wherein the feed end and the ground end are both perpendicularly extended from one end of the radiating body; the feed end, the radiating body, the ground end and the second side wall cooperatively enclose a close slot.

2. The wireless communication device of claim 1, wherein the radiating body is substantially rectangular.

3. The wireless communication device of claim 2, further comprises a connection member, wherein the feed end is connected to one of the second side walls by the connection member, the ground end is directly connected to the one of the second side walls, another end of the radiating body defines a first gap with the other of the second side walls.

4. The wireless communication device of claim 1, wherein the radiating body is substantially L-shaped and comprises a first radiating section and a second radiating section perpendicularly connected to an end of the first radiating section.

5. The wireless communication device of claim 4, further comprising a connection member, wherein the feed end is connected to one of the second side walls by the connection member, the ground end is directly connected to one of the second side walls, another end of the radiating body defines a second gap with the other of the second side walls.

6. The wireless communication device of claim 1, wherein the radiating body is substantially T-shaped and comprises a first radiating section and a second radiating section perpendicularly connected to a middle portion of the first radiating section.

7. The wireless communication device of claim 6, further comprising a connection member, wherein the feed end is connected to one of the second side walls by the connection member, the ground end is directly connected to one of the second side walls, another end of the radiating body defines a first gap with the other of the second side walls.

8. The wireless communication device of claim 1, wherein the radiating body is substantially rectangular sheet, the radiating body defines a cut at one end of the radiating body adjacent to the ground end.

9. The wireless communication device of claim 8, wherein one side of the radiating body opposite to the feed end and the ground end defines a fourth gap with the other of the second side walls.

10. A wireless communication device, comprising:

a housing, the housing defining a chamber, the chamber comprising a bottom wall, two opposite first side walls, and two opposite second side walls connected to the first side walls, the first side walls and the second side walls surrounding around the bottom wall; and an antenna, the antenna comprising a radiating body, a feed end, and a ground end, the feed end and ground end extending from the radiating body and connected to one of the second sidewalls, the antenna coupled with the chamber by the feed end and the ground end to activate resonation modes and obtain a corresponding working frequency band, the feed end and the ground end being in parallel, a length of the feed end being slightly shorter than that of the ground end, the radiating body, the feed end and the ground end being coplanar;

wherein the feed end and the ground end are both perpendicularly extended from one end of the radiating body; the feed end, the radiating body, the ground end and the second side wall cooperatively enclose a close slot.

11. The wireless communication device of claim 10, wherein the radiating body is substantially rectangular.

12. The wireless communication device of claim 11, further comprises a connection member, wherein the feed end is connected to one of the second side walls by the connection member, the ground end is directly connected to the one of the second side walls, another end of the radiating body defines a first gap with the other of the second side walls.

13. The wireless communication device of claim 10, wherein the radiating body is substantially L-shaped and comprises a first radiating section and a second radiating section perpendicularly connected to an end of the first radiating section.

14. The wireless communication device of claim 13, further comprises a connection member, wherein the feed end is connected to one of the second side walls by the connection member, the ground end is directly connected to one of the second side walls, another end of the radiating body defines a second gap with the other of the second side walls.

15. The wireless communication device of claim 10, wherein the radiating body is substantially T-shaped and comprises a first radiating section and a second radiating section perpendicularly connected to a middle portion of the first radiating section.

16. The wireless communication device of claim 15, further comprises a connection member, wherein the feed end is connected to one of the second side walls by the connection member, the ground end is directly connected to one of the second side walls, another end of the radiating body defines a first gap with the other of the second side walls.

17. The wireless communication device of claim 10, wherein the radiating body is substantially rectangular sheet, the radiating body defines a cut at one end of the radiating body adjacent to the ground end.

18. The wireless communication device of claim 17, wherein one side of the radiating body opposite to the feed end and the ground end defines a fourth gap with the other of the second side walls.

* * * * *